US006745588B2

(12) United States Patent
Kahler

(10) Patent No.: US 6,745,588 B2
(45) Date of Patent: Jun. 8, 2004

(54) DISPLAY DEVICE

(75) Inventor: Shawn M. Kahler, Midlothian, VA (US)

(73) Assignee: Delaware Capital Formation, Inc., Wilmington, DE (US)

( * ) Notice: Subject to any disclaimer, the term of this patent is extended or adjusted under 35 U.S.C. 154(b) by 63 days.

(21) Appl. No.: 10/174,397

(22) Filed: Jun. 18, 2002

(65) Prior Publication Data

US 2003/0230095 A1 Dec. 18, 2003

(51) Int. Cl.[7] ..... A47F 3/04

(52) U.S. Cl. ..... 62/246; 62/448; 312/116; 211/169.1

(58) Field of Search ..... 62/246, 249, 250, 62/378, 440, 448; 312/116, 249.1, 249.7; 211/169.1, 175, 1.51

(56) References Cited

U.S. PATENT DOCUMENTS

| | | | | |
|---|---|---|---|---|
| 1,594,653 | A | | 8/1926 | Anstey |
| 1,691,706 | A | | 11/1928 | Daemicke |
| 1,721,145 | A | | 7/1929 | Bromann |
| 1,896,693 | A | | 2/1933 | Battista |
| 2,136,232 | A | | 11/1938 | Bromann, Jr. ..... 62/89.5 |
| 3,937,033 | A | | 2/1976 | Beckwith et al. ..... 62/155 |
| 4,265,092 | A | | 5/1981 | Abraham ..... 62/155 |
| 4,361,012 | A | | 11/1982 | Ibrahim ..... 62/82 |
| 4,369,631 | A | | 1/1983 | Abraham ..... 62/82 |
| 4,369,632 | A | | 1/1983 | Abraham ..... 62/82 |
| 4,370,867 | A | | 2/1983 | Ibrahim ..... 62/256 |
| 4,375,155 | A | | 3/1983 | Rosanio et al. ..... 62/256 |
| 4,404,816 | A | | 9/1983 | Ibrahim et al. ..... 62/282 |
| 4,457,139 | A | | 7/1984 | Ibrahim ..... 62/256 |
| 4,478,047 | A | | 10/1984 | Ibrahim ..... 62/82 |
| 4,489,995 | A | * | 12/1984 | Barr ..... 312/236 |
| 4,514,988 | A | | 5/1985 | Ibrahim ..... 62/82 |
| RE31,909 | E | | 6/1985 | Ibrahim ..... 62/82 |
| 4,635,447 | A | * | 1/1987 | Casanova et al. ..... 62/448 |
| 4,691,886 | A | * | 9/1987 | Wendling et al. ..... 248/183.1 |
| 4,938,034 | A | | 7/1990 | Rosanio et al. ..... 62/256 |
| 4,977,754 | A | | 12/1990 | Upton et al. ..... 62/248 |
| 5,116,274 | A | * | 5/1992 | Artwohl et al. ..... 312/116 |
| 5,171,076 | A | * | 12/1992 | Eming ..... 312/116 |
| 5,261,253 | A | * | 11/1993 | Spenard ..... 62/250 |
| 5,277,486 | A | * | 1/1994 | Bustos ..... 312/125 |
| 5,314,080 | A | * | 5/1994 | Wentworth ..... 211/181.1 |
| 5,344,033 | A | * | 9/1994 | Herman ..... 211/150 |
| 5,475,988 | A | | 12/1995 | McGovern ..... 62/256 |
| 5,501,516 | A | | 3/1996 | Federico ..... 312/116 |
| 5,508,898 | A | | 4/1996 | McGovern ..... 362/92 |
| 5,606,863 | A | | 3/1997 | Kicklighter et al. ..... 62/89 |
| 5,639,149 | A | * | 6/1997 | Grassmuck ..... 312/116 |

(List continued on next page.)

FOREIGN PATENT DOCUMENTS

| | | | | |
|---|---|---|---|---|
| DE | 003344190 A1 | * | 6/1985 | ..... 312/239 |
| EP | 291381 | * | 11/1988 | ..... 312/116 |

*Primary Examiner*—William E. Tapolcai
*Assistant Examiner*—Mohammed M. Ali
(74) *Attorney, Agent, or Firm*—Foley & Lardner LLP

(57) ABSTRACT

An adjustable angle display device for holding and displaying objects includes a base portion, a display portion coupled to the base portion and adapted to pivot about a pivot point, and a positioning device having a first end coupled to the base portion and a second end coupled to the display portion, the positioning device adapted to adjustably position the display portion in a first position and a second position relative to the base. A method of providing an adjustable angle display device includes pivotally coupling a first end of a display portion to a base portion, providing a positioning device to selectively raise and lower a second end of the display device relative to the base portion, coupling the positioning device in operable engagement with the base portion and the display portion, and operating the positioning device to selectively adjust a display angle of the display device.

27 Claims, 4 Drawing Sheets

U.S. PATENT DOCUMENTS

| | | | | |
|---|---|---|---|---|
| 5,644,831 | A | 7/1997 | Federico | 29/455.1 |
| 5,924,297 | A | 7/1999 | Wolff et al. | 62/152 |
| D413,459 | S | 9/1999 | Evdokimoff | D6/472 |
| 6,128,911 | A | 10/2000 | Mathews et al. | 62/256 |
| 6,151,904 | A | 11/2000 | Jin | 62/248 |
| RE37,054 | E | 2/2001 | Sherwood | 62/246 |
| 6,185,951 | B1 | 2/2001 | Lane et al. | 62/246 |
| 6,272,876 | B1 | 8/2001 | Roberts et al. | 62/255 |
| 6,381,972 | B1 | 5/2002 | Cotter | 62/126 |
| 6,381,976 | B1 | 5/2002 | Kempiak et al. | 62/255 |
| 6,547,346 | B2 * | 4/2003 | Topper et al. | 312/116 |
| 2001/0042383 | A1 | 11/2001 | Chiang et al. | 62/246 |
| 2001/0042384 | A1 | 11/2001 | Chaing et al. | 62/246 |

* cited by examiner

DISPLAY DEVICE

FIELD OF THE INVENTION

The present invention relates to a display case. The present invention relates more particularly to an adjustable angle display case. The present invention relates more particularly to a refrigerated or temperature controlled adjustable angle display case.

BACKGROUND

It is known to provide a display device for displaying objects or products for sale in commercial environments such as supermarkets and grocery stores. Such display devices may be non-refrigerated or may have a refrigeration system such as a refrigerator, freezer, temperature controlled case, merchandiser, etc. that may be used for storing or displaying refrigerated or frozen objects or products. For example, it is known to provide a refrigerated case for display and storage of frozen or refrigerated foods in a supermarket or grocery store to maintain the foods at a suitable temperature (e.g. 32–35 degrees F.) well below the room or ambient air temperature within the store. Such temperature controlled display devices often are required to maintain the temperature of a space or an object within a particular, controlled range, while providing optimum visual accessibility of the objects within the display device. However, such known temperature controlled display cases typically do not provide a display portion that is independently adjustable from the base portion of the case. It is also generally known to provide non-refrigerated display devices such as fruit and vegetable stands or displays that may have a display portion having a display angle that is adjustable in several discrete positions for changing the display angle. Such non-refrigerated display devices typically include a leg, brace or stand having one or several adjustment positions for configuring the display portion at one of several discrete display angles.

Such known display devices may also have internal shelving or display platforms provided at an angle for improved viewing by a consumer, customer, or other user of the objects or products stored or displayed on the shelves or platforms. Such known display devices are typically fixed devices that may have internal shelving or display platforms that are manually adjustable by altering the shelving or platform angle and providing a support beneath the shelving or platform to hold the shelving or platform in the altered position. Such known display devices may require removing the objects to reposition the shelves or platform and may result in obscuring other objects or products when multiple shelves are provided.

In such known display devices having refrigeration systems or temperature controlled cases, fixed piping for refrigerant and drain lines are typically provided that restrict the ability to move or reconfigure the position of the temperature controlled portion of the display device relative to a base portion of the case.

Accordingly, it would be advantageous to provided a display device for adjusting the angle of the display portion of the display device within a generally unlimited number of positions over a desired display angle range. It would also be advantageous to provide a system for adjusting the display angle of the display device without having to remove objects or products stored in the device. It would also be advantageous to provide a system for adjusting the display angle of all internal shelving or platforms within the display device in a single operation. It would be further advantageous to provide a system for adjusting the angle of the display portion of a refrigerated display device that is unimpeded by refrigeration equipment, piping, drainage, or other components of the display portion of the display device.

Accordingly, it would be advantageous to provide a display device with an adjustable angle positioning system having any one or more of these or other advantageous features.

SUMMARY

The present invention relates to a temperature controlled display device having an adjustable angle display system for holding and displaying objects and includes a base portion, a display portion coupled to the base portion and adapted to pivot about a pivot point, and a positioning device having a first end coupled to the base portion and a second end coupled to the display portion, the positioning device adapted to adjustably position the display portion in a first position and a second position relative to the base portion.

The present invention also relates to a method of providing an adjustable angle display device for a temperature controlled case and includes pivotally coupling a first end of a display portion to a base portion, providing a positioning device to selectively raise and lower a second end of the display device relative to the base portion, coupling the positioning device in operable engagement with the base portion and the display portion, and operating the positioning device to selectively adjust a display angle of the display device.

The present invention further relates to a refrigerated merchandiser having an adjustable angle display portion and includes a base portion having a refrigeration device and pivotally supporting the adjustable angle display portion, at least one cooling device in cooling communication with the adjustable angle display portion, at least one coolant interface communicating between the refrigeration device and the cooling device, a positioning device operably engaging the base portion and the adjustable angle display portion to pivotally adjust a display angle of the display portion relative to the base portion.

The present invention further relates to an adjustable angle display device and includes an upper display portion pivotally supported on a lower base portion, a display angle adjustment device operably engaging the display portion and the base portion, where the adjustment device includes a linear actuation device to deliver an extension or retraction force in a first direction of motion, and is coupled to a linkage device to move the display portion in a second direction of motion.

DETAILED DESCRIPTION OF THE PREFERRED EMBODIMENTS

Figure 1A:
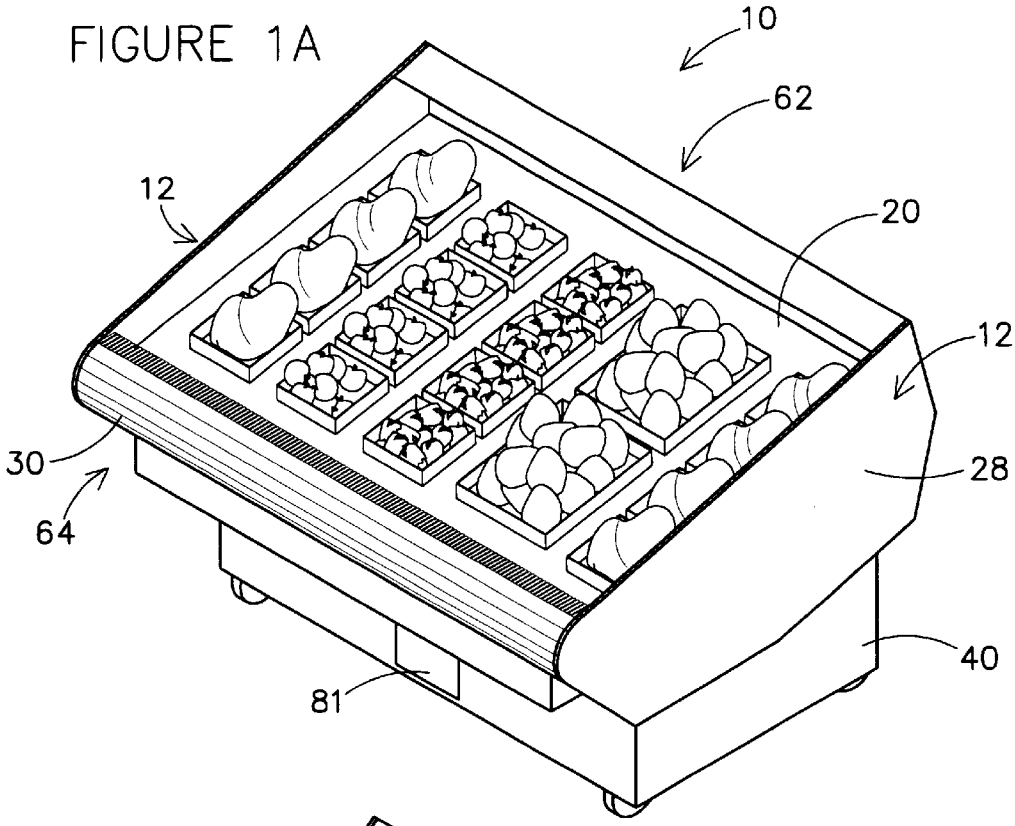
FIG. 1A is a perspective view of a display device in a first position according to a preferred embodiment.
Figure 2A:
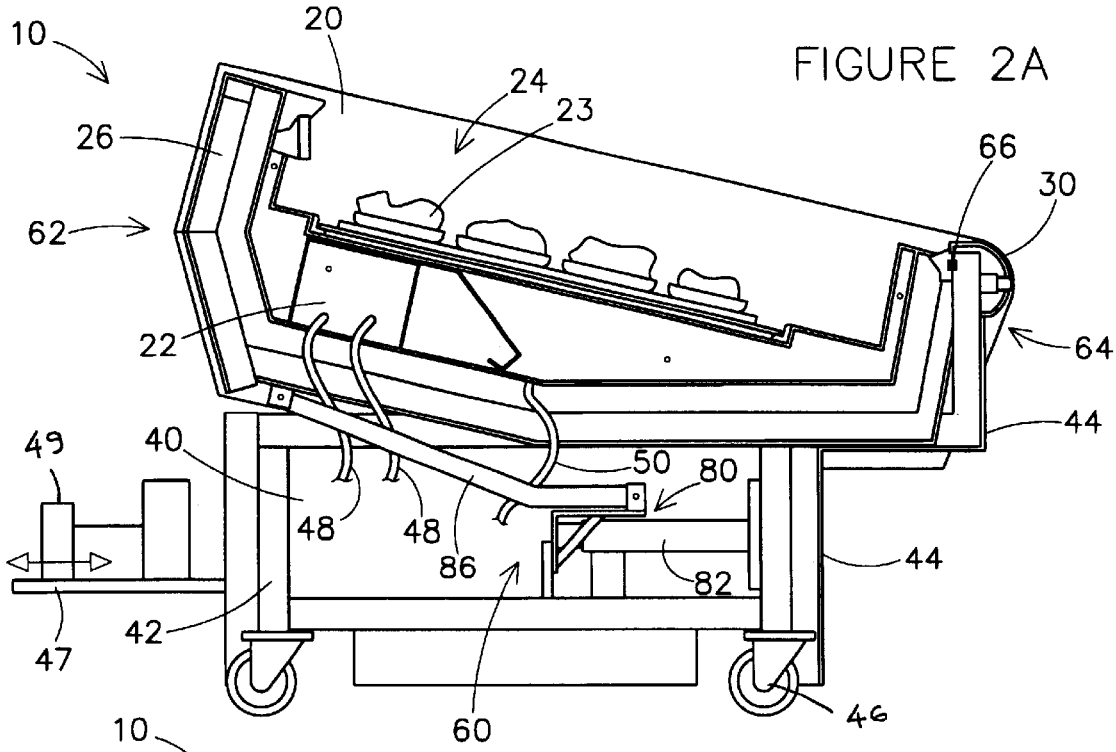
FIG. 2A is a side view of a display device in a first position according to a preferred embodiment.

Referring to FIGS. 1A and 2A, a display device is shown according to a preferred embodiment. Display device 10 may be a non-refrigerated display device (e.g. produce stand, merchandise rack, case holder, compartment system, storage bins, etc.) or a refrigerated or temperature controlled display device (e.g. refrigerated merchandiser, temperature controlled case, etc.). Display device 10 includes a display portion 20 for storing and displaying products or objects (e.g. produce items, prepackaged items, ready-made meals, general merchandise, etc.) and a base portion 40 for supporting display portion 20 and for housing equipment (e.g. refrigeration and/or cooling components, storage devices, etc.) associated with the display portion. An angle adjustment positioning system 60 (shown schematically in FIGS. 2A–3B) is provided in connection with display portion 20 and base portion 40 to selectively adjust the display angle of display portion 20 in a number of positions throughout an adjustment range relative to base portion 40 to adapt the display device 10 for improved visibility of particular objects being displayed to consumers or customers.

Figure 1B:
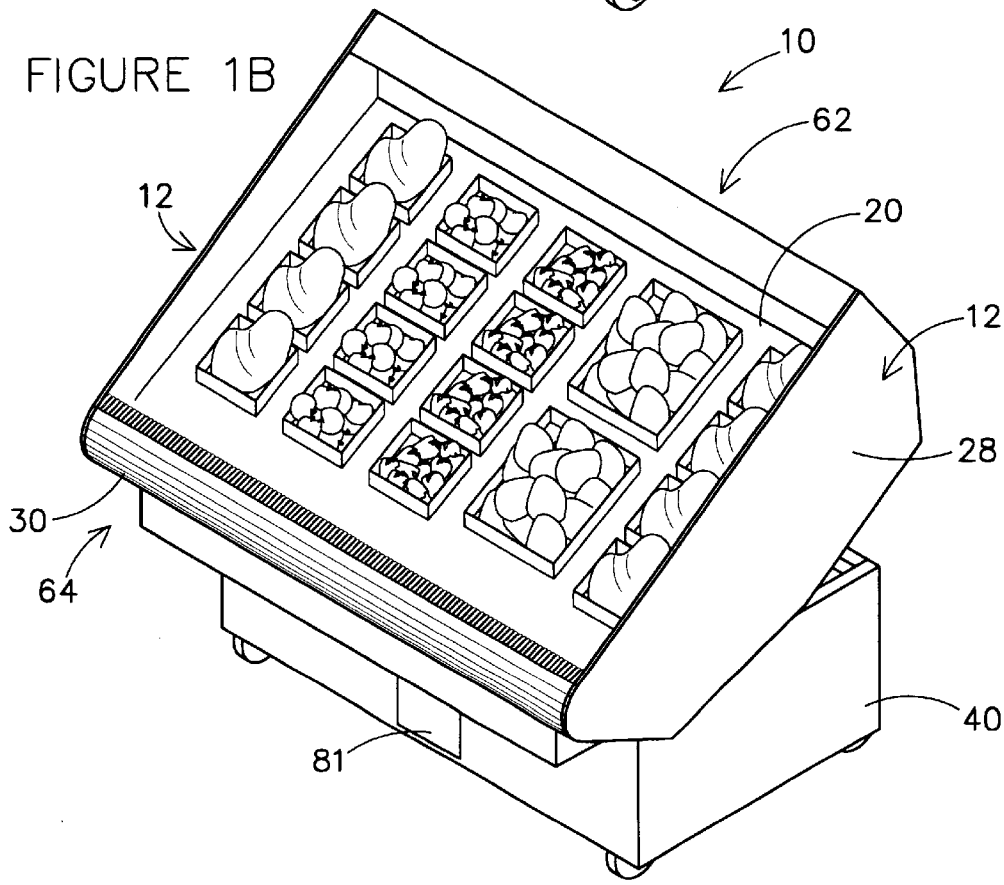
FIG. 1B is a perspective view of a display device in a second position according to a preferred embodiment.

Referring further to FIGS. 1A and 1B, display portion 20 may be provided with a see-through enclosure for viewing the objects or may be provided with an open top or front for reach-in accessibility of the objects. In a refrigerated or temperature controlled display device, the display portion 20 includes one or more cooling devices shown schematically as cooling interfaces 22 such as direct expansion refrigerant cooling coils, liquid-flow cooling coils, pans or shelves with flow-through liquid coolant passages, etc. for circulating cooled air on, around or beneath the objects 23 to be displayed. In a particularly preferred embodiment, display device 10 is a refrigerated display device having a display portion 20 provided in the shape of a recessed storage compartment 24 (shown schematically as a tub-shaped basin) formed with a frame 26 (e.g. steel tubing, plastic tubing, wood, etc.) with a layer of insulation and surrounded by suitable cover panels 28. In a particularly preferred embodiment, frame 26 is formed of one and one-half (1½) inch square steel tubing and the insulation is polyurethane foam. The cover panels 28 on the sides of display portion 20 are provided with a sufficient size and shape to substantially cover the upper sides of base portion 40 throughout the range of angular adjustment of display portion 20. The front leading edge of display portion 20 is provided with a resilient guard 30 (i.e. bumper, cushion, etc.) to protect display portion 20 from contact with objects such as shopping carts, delivery carts, etc. The cooling interface 22 is provided in a lower portion of recessed storage compartment 24 with suitable fans, louvers or air flow directional guides (not shown) for distributing the cooled air within recessed storage compartment 24 to maintain the displayed objects at a desired temperature.

The display device 10 also includes base portion 40 beneath the display portion 20 having a frame 42 and suitably sized cover panels 44 on the front, back and sides. Mobility interfaces or devices 46 (such as wheels, casters, rollers, etc.) that may be provided with locking features are provided on the bottom of base portion 40 to allow display device 10 to be moved to any desirable location for display of the objects contained therein. Display device 10 is provided with narrow, planar side walls 12 to allow several display devices to be grouped together to provide a multiple unit display system that can be customized to suit the various objects to be displayed and the display plans of the intended installation location (e.g. supermarkets, grocery stores, cafeterias, restaurants, food service kitchens, etc.).

For display devices having a refrigeration system, base portion 40 houses a cooling system (e.g. direct expansion refrigeration system, etc.—shown schematically as refrigeration system 49) that may be completely or partially self-contained and include various configurations of one or more of the following conventional components: one or more compressors, a condenser, a receiver tank, an expansion device, and a piping system (not shown) made of copper or other suitable material and interconnecting the components for conveying a vapor expansion refrigerant such as R-22, R-507 or R-404A, or other suitable coolant in a closed-loop cycle. The cooling system components may also include other typical components such as filters, dryers, oil separators, regulators, valves, sight glasses, etc. (not shown) that are suitable for a particular cooling system. The cooling system components may be configured on a draw-out device (e.g. skid, drawer, etc.) shown schematically as an extendable and retractable tray 47 having friction reducing devices such as rollers or glides to allow the components to be easily accessed from the side or the rear of display device 10 for maintenance, adjustment and repair. In an alternative embodiment, the display device may have a two loop system with a primary direct expansion refrigerant loop and a secondary liquid coolant loop. The primary loop may be located remotely, or wholly or partially within the base and routed through a heat exchange device to cool a liquid coolant in the secondary loop which is circulated through the cooling interfaces (not shown).

A drain receptacle or reservoir (not shown) may also be included within base portion 40 for receiving and collecting liquids, such as those liquids resulting from defrosting of cooling interfaces 22, or condensation, cleaning operations, spills or other sources of liquid, from the display portion 20. A flexible coolant interface or member 48, shown schematically as flexible hoses, are provided for communicating between cooling interfaces 22 in display portion 20 and the coolant or refrigerant piping in base portion 40. In a particularly preferred embodiment, flexible coolant interface or member 48 is one or more high-pressure flexible hoses such as a Super Flex hose commercially available from Parker Hannifin of Wickliffe, Ohio. A flexible drain interface or member 50, shown as flexible hoses, are provided for communicating between the display portion 20 and the drainage reservoir in base portion 40. In a particularly preferred embodiment, flexible drain interface or member 50 is a conventional rubber hose or tubing. Flexible coolant interface or member 48 and flexible drain interface or member 50 create a degree of independence between base portion 40 and display portion 20 so that display portion 20 is adjustably movable relative to base portion 40 without being impeded by, or interfering, with the refrigerant or coolant piping and/or drainage piping.

Figure 2B:
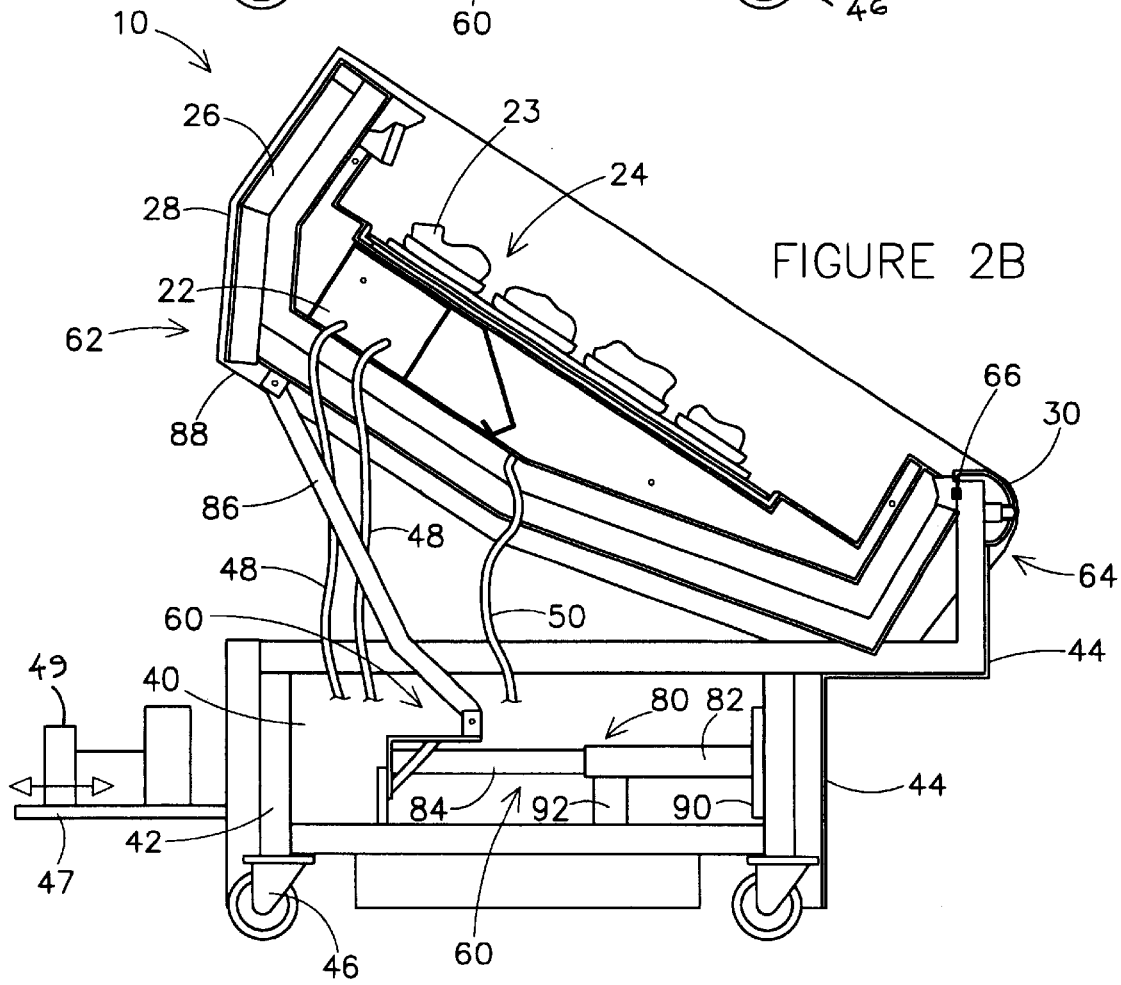
FIG. 2B is aside view of a display device in a second position according to a preferred embodiment.

Referring to FIGS. 1B and 2B, a display device is shown with an adjustable angle positioning system 60 according to a preferred embodiment. Adjustable angle positioning system 60 allows the display angle of display portion 20 to be adjustable throughout a desired display angle range by allowing one part of display portion 20 (shown as a rear end 62) to be elevated while another part of display portion 20 (shown as front end 64) pivots about a fixed pivot point 66. In any preferred embodiment, positioning system 60 is capable of adjustably elevating rear end 62 of display portion within a range corresponding to zero (0) degrees (i.e. the fully retracted position) to forty-five (45) degrees (i.e. the fully elevated position) from horizontal. In a particularly preferred embodiment, the display portion has a fully retracted position of about fifteen (15) degrees from horizontal and is capable of angular adjustment within the range of up to forty-five (45) degrees from horizontal, however, other ranges of elevation adjustment may be provided that are suitable for displaying objects stored in other display devices. Flexible interfaces 48 and 50 allow display portion 20 to move relative to base portion 40, while maintaining the weight, size and complexity of the refrigeration or cooling system components within base portion 40. Positioning system 60 interfaces with the display portion 20 and with base portion 40 to allow the display angle of display portion 20 to be adjusted relative to base portion 40. The angle of display portion 20 relative to base portion 40 may be selectively adjusted to optimize the line of sight for particular objects or products stored in display portion 20 to be viewed by a consumer or customer.

Referring further to FIGS. 1B and 2B, positioning system 60 interfaces with the display portion 20 and the base portion 40 in the following manner. Base portion 40 includes a structural device shown schematically as frame 42 having a front wall portion shown as front panel 44 attached thereto that provides an enclosure for base portion 40 and presents an aesthetically pleasing appearance for the display device 10. The front portion of display portion frame 26 is coupled to an upper location on base portion frame 42 to allow movement of display portion 20 relative to base portion 40, shown schematically as pivoting movement at a pivot point 66. In a particularly preferred embodiment, the pivot point 66 is located such that the position of resilient guard 30 remains relatively unchanged throughout the entire range of display angle adjustment so that the protective features of resilient guard 30 are maintained throughout the display angle range. In a particularly preferred embodiment, pivot point 66 is provided at each lateral end of front panel 44 and consists of mating lugs having apertures configured along a common axis and pivot members (e.g. bolts, pins, rods, etc.) with bushings provided through the apertures to create a pivot point. In an alternative embodiment, the pivot point may be an elongated pivoting joint or hinge, such as a piano-type hinge. In another alternative embodiment, the display portion may be movable along an arcuate guide or track on the base portion for adjustably changing the display angle of the display portion.

Referring further to FIGS. 1B and 2B, positioning system 60 includes a positioning device or actuator 80 for providing an axial force in an extendable and retractable direction. In a particularly preferred embodiment, actuator 80 has a fixed member 82 shown schematically as an outer cylinder coupled to a lower portion of frame 42 of base portion 40, and an extensible member 84 shown schematically as an inner member that is telescopingly received within fixed member 82. A removable access panel 81 is provided on the front wall of base 40 to provide access for actuating the actuator 80. A motion transfer device shown schematically as a linkage 86 (i.e. bar, rod, strut, etc.) has a first end movably coupled (e.g. pivotally, rotationally, etc.) to extensible member 84, and a second end moveably coupled (e.g. pivotally, rotationally, etc.) to display portion 20. In a particularly preferred embodiment, the second end of extensible member 84 is coupled to an underside 88 of display portion 20 in a position suitable for developing the desired range of motion and having the desired mechanical advantage for moving the weight of display portion 20 when fully loaded with objects 23 to be displayed. Extensible member 84 is capable of selective retraction into fixed member 82 (see FIG. 2A) for lowering display portion 20 relative to base portion 40 or selective extension from fixed member 82 (see FIG. 2B) for raising display portion 20 relative to base portion 40. Display portion 20 may be positioned in an adjustable manner throughout the display angle adjustment range about pivot point 66, corresponding to the length of extension or retraction of extensible member 84 relative to fixed member 82 as linkage 86 elevates or lowers the rear end 62 of display portion 20.

Figure 3A:
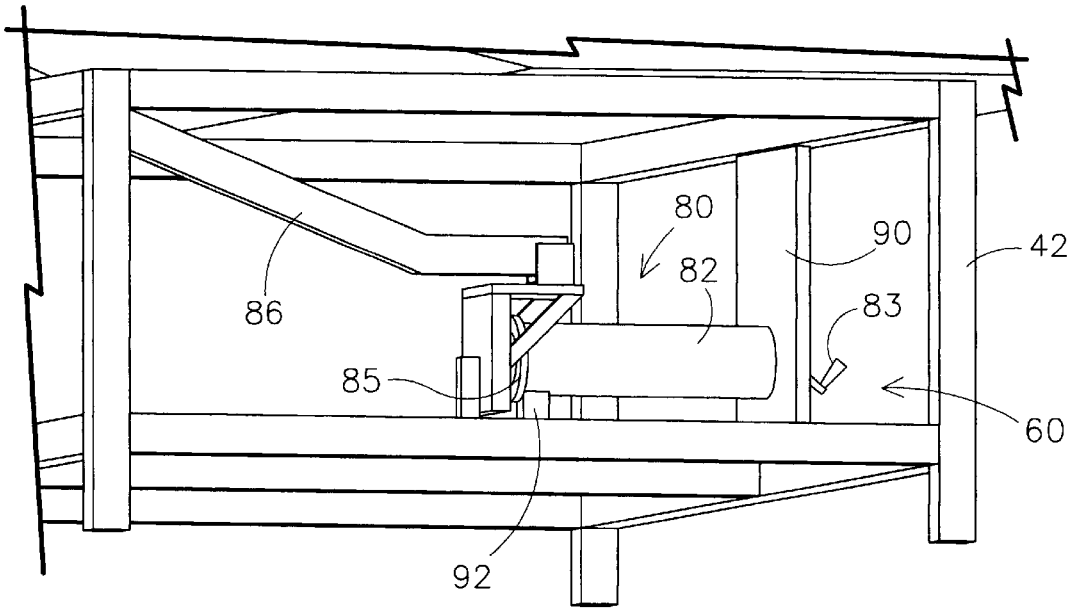
FIG. 3A is a perspective view of a portion of a display device in a first position according to a preferred embodiment.
Figure 3B:
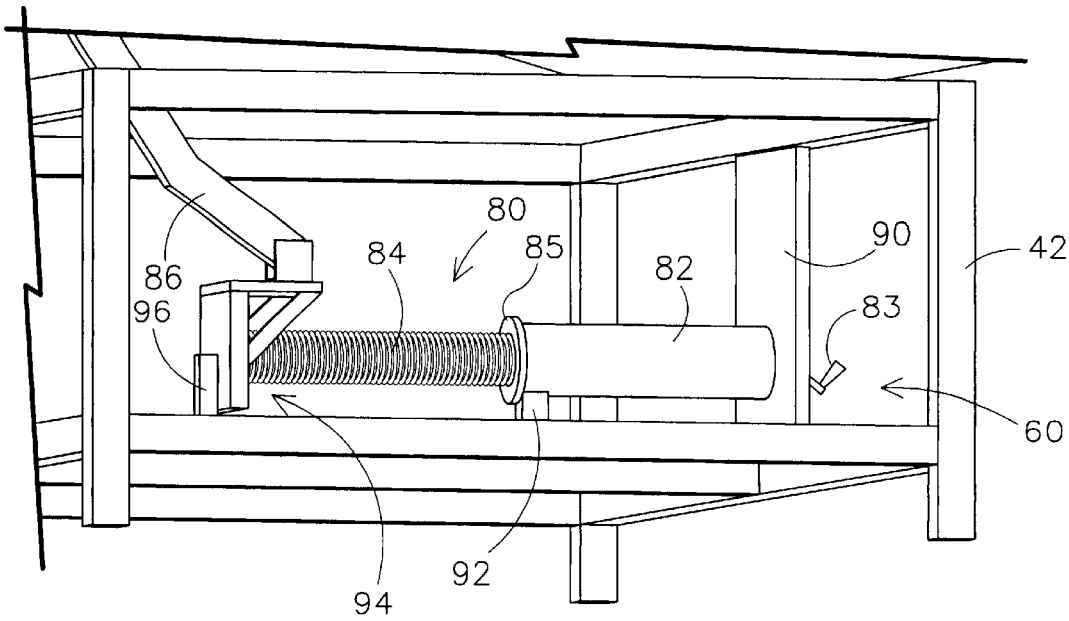
FIG. 3B is a perspective view of a portion of a display device in a second position according to a preferred embodiment.

Referring to FIGS. 3A and 3B, the elements of positioning system 60 are shown according to a preferred embodiment. Fixed member 82 and extensible member 84 are shown oriented in a generally horizontal position with a common axis that is generally perpendicular to front panel 44 of base portion 40. Fixed member 82 is attached to frame 42 of base portion 40 by holders (shown schematically as brackets 90 and 92 that may be assembled by welding, bolting or other suitable fastening method) and extensible member 84 has an outer end 94 that is guided by a support (shown schematically as a bracket 96) that slidably interfaces with frame portion 42 (e.g. rollers, low-friction glides, etc.). In an alternative embodiment, the extensible member may be provided without a guide or support, or may be coupled directly to the display device or an extension of the display device.

Figure 4:
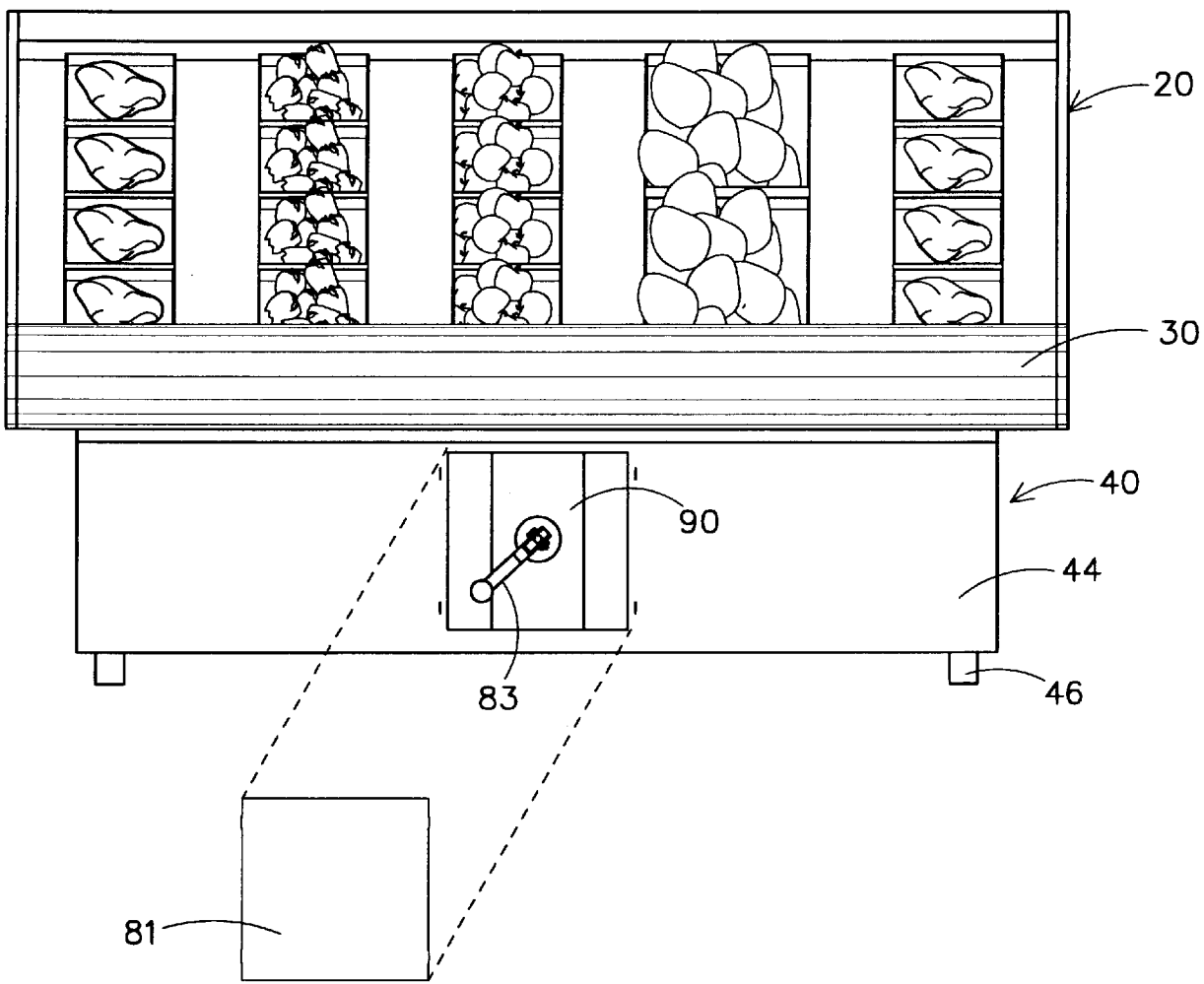
FIG. 4 is a front view of a display device according to a preferred embodiment.

Referring to FIGS. 3A, 3B and 4, extensible member 84 and fixed member 82 include an adjustment device for selectively adjusting the position of extensible member 84 relative to fixed member 82. In a particularly preferred embodiment, the adjustment device is a threaded drive member such as a conventional screw-jack device having a rotatable threaded rod and non-rotating drive nut (shown schematically as nut 85 in FIG. 3B), where the threaded rod may be rotated manually by an actuator 83 (shown schematically as a hand-crank or lever), such as may be accessed through removable access panel 81. In an alternative embodiment, the drive member may be electrically operated with a suitable motor and gear box arrangement. In another alternative embodiment, the axis of the fixed member and the extensible member may be oriented vertically beneath the rear end of the display case, or oriented at any suitable angle between horizontal and vertical for selectively adjusting the height of the rear end of display case about the pivot point at the front of the display portion. In a further alternative embodiment, the adjustment device may be a pneumatic or hydraulic cylinder that is coupled between the frame of the base portion and the underside of the display portion, or provided with a suitable interfacing linkage, and having sufficient capacity to raise and lower a display portion of a temperature controlled display device containing objects to be stored and displayed. In other alternative embodiments, the removable access panel may be provided at any suitable location on the display device for actuating the actuator.

Referring further to FIGS. 3A and 3B, a motion transfer device or linkage for an adjustable angle positioning system is shown. Linkage 86 is pivotally coupled to extension member 84 and to underside 88 of display portion 20, such that the generally horizontal movement of extensible member 84 results in the generally vertical movement of the rear end 62 of display portion 20. Linkage 86 may be joined to underside 88 and extensible member 84 by any conventional pivoting arrangement such as brackets and pins, bushings, threaded fasteners, etc. In a particularly preferred embodiment, linkage 86 is configured in a one-piece rigid shape corresponding generally to the contour of the underside 88 of display portion 20 (shown as an angled or dog-leg shape, but may be arcuate or any other suitable shape) and connected to extensible member 84 in a cantilever configuration to develop the desired range of movement at rear end 62 of display portion 20. In an alternative embodiment, the linkage may be provided in jointed segments such as a V-shaped configuration, scissor-jack configuration, post-jack configuration, or other configuration having joined, pivoting segments.

It is important to note that the construction and arrangement of the elements of the adjustable angle display device provided herein are illustrative only. Although only a few exemplary embodiments of the present invention have been described in detail in this disclosure, those skilled in the art who review this disclosure will readily appreciate that many modifications are possible in these embodiments (such as variations in features such as components, positioning devices, frame configurations, pivot locations, base and display portion orientations; variations in sizes, structures, shapes, dimensions and proportions of the components of the system, use of materials, combinations of shapes, etc.) without materially departing from the novel teachings and advantages of the invention. For example, the adjustable angle display device may be adapted for use in a wide variety of commercial or institutional applications, including supermarkets, farm markets, hotels, restaurants, cafeterias, convenience stores, delis, food-service kitchens, etc. and may be provided in any number, size, orientation and arrangement to suit the particular product storage and display requirements of the installation location. Further, it is readily apparent that variations of the angle adjustment display device and its components and elements may be provided in a wide variety of types, shapes, sizes and performance characteristics, or provided in locations external or internal to the display device. For example, the display portion may have a convex underside adapted for slideable movement along a correspondingly concave support portion on the base. Accordingly, all such modifications are intended to be within the scope of the inventions.

The order or sequence of any process or method steps may be varied or re-sequenced according to alternative embodiments. In the claims, any means-plus-function clause is intended to cover the structures described herein as performing the recited function and not only structural equivalents but also equivalent structures. Other substitutions, modifications, changes and omissions may be made in the design, operating configuration and arrangement of the preferred and other exemplary embodiments without departing from the spirit of the inventions as expressed in the appended claims.

What is claimed is:

1. A temperature controlled display device having an adjustable angle display system for holding and displaying objects, comprising:

a base portion;

a display portion coupled to the base portion and adapted to pivot about a pivot point; and a positioning device having an actuator and a first end coupled to the base portion and a second end coupled to the display portion, the positioning device configured to adjustably position the display portion in a first position and a second position relative to the base portion.

2. The temperature controlled display device of claim 1, wherein the display portion is adapted to display refrigerated objects.

3. The temperature controlled display device of claim 1, wherein the base portion houses a refrigeration system in communication with at least one cooling interface in the display portion.

4. The temperature controlled display device of claim 3, further comprising at least one flexible hose adapted to couple the refrigeration system to the cooling interface.

5. The temperature controlled display device of claim 1, wherein the positioning device includes an elongated telescoping device having a fixed member and an extension member.

6. The temperature controlled display device of claim 5, wherein the extension member is selectively extendable and retractable relative to the fixed member by a threaded drive device.

7. The temperature controlled display device of claim 5, wherein the positioning device includes a linkage member operably engaging the extension member and the display portion.

8. The temperature controlled display device of claim 5, wherein the elongated telescoping device is configured substantially horizontally.

9. The temperature controlled display device of claim 1, wherein the pivot point is located at a front end of the display device and the positioning device is adapted to raise and lower a rear end of the display portion to provide a plurality of adjustable display positions.

10. The temperature controlled display device of claim 1, further comprising at least one mobile interface coupled to the base and adapted to selectively position the temperature controlled display device in a desired location.

11. A method of providing an adjustable angle display device for a temperature controlled case, the method comprising:

pivotally coupling a first end of a display portion to a base portion;

providing a positioning device adapted to selectively raise and lower a second end of the display portion relative to the base portion;

coupling the positioning device in operable engagement with the base portion and the display portion; and operating an actuator for the positioning device to selectively adjust a display angle of the display portion.

12. The method of claim 11, further comprising providing a refrigeration system in the base portion adapted to interface with at least one cooling interface in the display portion.

13. The method of claim 11, wherein the positioning device includes a telescopingly extendable and retractable drive member.

14. The method of claim 13, wherein the positioning device further includes a linkage device coupled to the display portion and operably engaging the telescopingly extendable and retractable drive member.

15. A refrigerated merchandiser for storing and displaying objects, and having an adjustable display portion, comprising:

a base portion having a refrigeration device, the base portion supporting the adjustable display portion;

at least one cooling device in cooling communication with the adjustable display portion;

at least one coolant member communicating between the refrigeration device and the cooling device;

a positioning device coupled to the base portion and configured to provide a force; and a motion transfer device operably engaging the positioning device and the adjustable display portion, and adapted to adjust a display angle of the adjustable display portion relative to the base portion.

16. The refrigerated merchandiser of claim 15, wherein a front end of the base portion is pivotally coupled to a front end of the adjustable display portion and the positioning device is operable to raise and lower a rear end of the adjustable display portion.

17. The refrigerated merchandiser of claim 15, wherein the refrigeration device is a self-contained unit located within the base portion.

18. The refrigerated merchandiser of claim 15, wherein the refrigeration device is coupled to a draw-out device.

19. The refrigerated merchandiser of claim 15, wherein the positioning device includes a drive screw member rotatably coupled to a linkage.

20. The refrigerated merchandiser of claim 15, wherein the coolant member is a flexible hose.

21. A temperature controlled case with an adjustable angle display device, comprising:

a display portion pivotally supported on a base portion;

a display angle adjustment device operably engaging the display portion and the base portion, the adjustment device including a linear actuation device adapted to deliver an extension or retraction force in a first direction of motion, the linear actuation device being coupled to a linkage device adapted to move the display portion in a second direction of motion.

22. The adjustable angle display device of claim 21, wherein the first direction of motion is substantially horizontal and the second direction of motion is substantially vertical.

23. The adjustable angle display device of claim 21, wherein a front end of the display portion is pivotally coupled to a front end of the base portion.

24. The adjustable angle display device of claim 21, wherein the adjustable angle display device is adapted for use in one of a supermarket, grocery store, deli, cafeteria, restaurant, or food service kitchen.

25. The adjustable angle display device of claim 21, wherein the linear actuation device is a drive screw member.

26. The adjustable angle display device of claim 21, wherein the display portion includes a cooling device adapted to cool objects.

27. The adjustable angle display device of claim 21, wherein the display portion is adjustably positionable in a plurality of angular positions relative to the base portion.

* * * * *